US009562323B2

(12) United States Patent
Heinola et al.

(10) Patent No.: US 9,562,323 B2
(45) Date of Patent: Feb. 7, 2017

(54) RECOVERY BOILER PLANT OF A CHEMICAL PULP MILL

(71) Applicant: ANDRITZ OY, Helsinki (FI)

(72) Inventors: Ari Heinola, Kotka (FI); Veli Riikonen, Kotka (FI)

(73) Assignee: Andritz Oy, Helsinki (FI)

( * ) Notice: Subject to any disclaimer, the term of this patent is extended or adjusted under 35 U.S.C. 154(b) by 0 days.

(21) Appl. No.: 14/400,821

(22) PCT Filed: May 16, 2013

(86) PCT No.: PCT/FI2013/050534

§ 371 (c)(1),
(2) Date: Nov. 13, 2014

(87) PCT Pub. No.: WO2013/171379

PCT Pub. Date: Nov. 21, 2013

(65) Prior Publication Data

US 2015/0184339 A1 Jul. 2, 2015

(30) Foreign Application Priority Data

May 16, 2012 (FI) ..... 20125529

(51) Int. Cl.
*D21C 11/12* (2006.01)
*E04H 5/02* (2006.01)
(Continued)

(52) U.S. Cl.
CPC ..... *D21C 11/122* (2013.01); *D21C 11/12* (2013.01); *E04H 5/02* (2013.01)

(58) Field of Classification Search
CPC ..... D21C 11/12; D21C 11/122; E04H 5/02; F28G 1/16; F28G 15/10; F04F 5/14; F04F 5/24; F27D 3/14; F23J 1/06; F23J 1/08; B01J 19/00; B01J 19/24
See application file for complete search history.

(56) References Cited

U.S. PATENT DOCUMENTS 4,421,596 A 12/1983 Hogberg
5,204,069 A 4/1993 Paxton et al.
(Continued)

FOREIGN PATENT DOCUMENTS

EP 1 681 512 A2 7/2006
EP 1 801 496 A2 6/2007
(Continued)

OTHER PUBLICATIONS

International Search Report issued in PCT/FI2013/050534 mailed Nov. 4, 2013.

*Primary Examiner* — Natasha Young
(74) *Attorney, Agent, or Firm* — Nixon & Vanderhye P.C.

(57) ABSTRACT

A recovery boiler plant of a chemical pulp mill including: a boiler including a lower region with an outlet to discharge smelt; a dissolving tank proximate to the outlet and configured to receive smelt; a smelt spout coupled to the outlet and including a chute extending from the outlet to a position at or over an inlet to the dissolving tank; and a shielding room including walls, a ceiling and a floor, wherein one of the walls includes a wall of the boiler, and the shielding room encloses a volume adjacent the boiler and above the dissolving tank, wherein the enclosed volume includes and the smelt spout and a working area in front of the smelt spout.

31 Claims, 3 Drawing Sheets

(51) Int. Cl.
*B01J 19/00* (2006.01)
*B01J 19/24* (2006.01)

(56) References Cited

U.S. PATENT DOCUMENTS

| | | | | |
|---|---|---|---|---|
| 5,800,773 | A * | 9/1998 | Beveridge | F27D 3/14 222/592 |
| 5,976,319 | A | 11/1999 | Paju et al. | |
| 7,900,567 | B2 * | 3/2011 | Haaga | F22B 37/48 110/173 R |
| 2011/0186659 | A1 * | 8/2011 | Kujanpaa | B05B 3/18 239/752 |

FOREIGN PATENT DOCUMENTS

| | | | |
|---|---|---|---|
| FI | 121313 | B | 9/2010 |
| WO | 2008/046959 | A1 | 4/2008 |
| WO | 2010063875 | A1 | 6/2010 |

* cited by examiner

RECOVERY BOILER PLANT OF A CHEMICAL PULP MILL

RELATED APPLICATIONS

This application is the U.S. national phase of International Application No. PCT/FI2013/050534 (now WO 2013/171379) filed 16 May 2013 which designated the U.S. and claims priority to FI 20125529 filed 16 May 2012, the entire contents of each of which applications are hereby incorporated by reference.

BACKGROUND OF INVENTION

The present invention relates to a recovery boiler plant of a chemical pulp mill having a smelt spout area comprising smelt spouts, which are connected to the lower part of the boiler for discharging smelt from the boiler into a dissolving tank, and a working area in front of the smelt spouts. The invention also relates to a method at a recovery boiler plant of a chemical pulp mill.

An essential apparatus in the recovery cycles of sulfate- and other Na-based pulping processes is the recovery boiler for waste liquor containing cooking chemicals, such as a soda recovery boiler, wherein the chemicals are processed into a form suitable for recovery purposes. The most important chemicals in a sulfate process are sodium and sulfur. Organic substances that have dissolved in waste liquid in the cooking are combusted in the boiler, generating heat that is utilized on one hand for converting inorganic compounds contained in the waste liquid back to chemicals to be used in cooking, and on the other hand for generating steam. The inorganic matter of the waste liquid melts in the high temperature of the boiler and flows in form of smelt onto the bottom of the furnace.

From the bottom of the boiler the chemical smelt is led via cooled smelt spouts into a tank, wherein it is dissolved in water or weak white liquor for producing soda liquor, i.e. green liquor. The main components of smelt, and thus also of green liquor, in the sulfate process are sodium sulfide and sodium carbonate. The green liquor is then led to the causticizing plant, where it is used for producing white liquor.

The dissolving tank is a large cylindrical tank having a horizontal bottom and cover. The tank is usually made of black plate and the interior of it is lined with water-proof concrete or acid-proof plate. The smelt is usually dispersed by directing a steam jet into the smelt stream flowing from the spout. Small explosions happen in the dissolving tank all the time, as anyone who has been near to dissolvers can conclude from the noise. Hot smelt flow causes crashes or explosions when falling into the dissolving tank. The noise is due to explosion reactions between smelt and water as smelt meets green liquor in the dissolving tank. The temperature of the smelt is in the range of 750-820° C. and the temperature of the green liquor (or weak white liquor) containing mainly water in the dissolver is in the range of 70-100° C.

The part of the smelt spout that extends to the outside of the wall of the furnace of the boiler is surrounded usually by a closed hood, i.e. protective housing, by means of which liquid and smelt splashes and vent vapors are prevented from passing to the surroundings. The bottom part of the hood is connected to a smelt dissolving tank located below the smelt spout, into which tank the smelt falls from the spout and wherein the smelt is dissolved in liquid forming green liquor. Nozzles spraying a medium for dispersing the smelt stream are typically mounted in the hood and directed towards the smelt stream falling from the spout. Smelt splashes can enter and stick to the hood and the walls of the dissolving tank. Smelt cakes thus formed also cause explosions when falling into the dissolving tank.

Working conditions of the recovery boiler are demanding. Splashes of hot chemical smelt, liquor, hot surfaces, high ambient temperature, chemical fumes in the breathing air and noise cause hazardous situations. Working in the vicinity of the smelt spouts is inevitable due to control, maintenance and overhaul work. It can e.g. be necessary to rod the smelt spouts, because of possible cloggings, which prevent the smelt from flowing. The noise exposure in chemical pulp mills is often over 85 dB.

FI-patent publication 121313 discloses a solution, where a shielding wall is arranged in front of the smelt spouts so that the operator is safe behind the wall when performing measures in the smelt spout area during operation. Thus, the shielding wall is located between the smelt spouts and the working area.

The heat in the smelt spout area, the noise and gases and smelt splashes possibly entering from the smelt spouts disturb also those who do not actually work in this area but are to walk or work in the vicinity thereof.

SUMMARY OF INVENTION

An object of the present invention is to improve safety in a recovery boiler plant, especially in the vicinity of the boiler.

The present invention is characterized in that the smelt spout area, comprising at least smelts spouts with equipment and a working space in front of them, is separated by means of a wall or walls to form a space separate from the rest of the recovery boiler plant. In the working space a worker works temporarily for performing operational, service and maintenance operations. More precisely, the recovery boiler plant and the method at the recovery boiler plant according to the present invention are characterized in, what is presented in the independent claim. Other embodiments are presented in the dependent claims. This allows improving the working and overall safety against adverse effects originating from the smelt spout area.

The central idea of the invention is to surround the smelt spouts and the working space outside them with a wall to form a shielding space or shielding room into which a person can easily enter for performing the normal maintenance and operational measures for the smelt spout area, but which space in normal conditions protects people walking and working outside the smelt spout area from the noise from the smelt spout area and splashes and fumes from the smelt spouts. Thus, the shielding room is arranged to be tight so that the noise level, working comfort and working safety of the surroundings of the shielding room are essentially improved. Thus, the shielding room improves essentially the safety and working comfort of people working and walking outside the shielding room.

A worker works inside the shielding room temporarily, when certain tasks require that. In other times, the shielding room isolates and protects the surroundings of the boiler against noise and other adverse effects.

The shielding room is a space, the walls, doors and ceiling of which are preferably made of sound insulating and heat-resistant material. The rear wall of the shielding room is a wall of the recovery boiler, typically the rear wall of the boiler, against which the ceiling and side walls of the shielding room are sealed in a suitable manner. Then the heat motions of the boiler with respect to the stationary level of the boiler, on which level the shielding room is located, are to be taken into account.

A door of the shielding room is typically located on the front wall, opposite the smelt spouts. The number of doors may be one or more. The doors may be horizontally moving sliding doors, vertically moving upward acting doors, doors pivoted at the sides or on top or other lamella or folding doors. It is important that sufficient noise isolation can be built in the doors. The doors of the shielding room can be manual, i.e. to be opened and moved using muscular strength, or motorized, moving by machine force. An advantageous embodiment is a sliding door. The doors or walls of the shielding room can be provided with a window or windows, which provide a safe view to the smelt spout area from outside the room. The doors may also be provided with hatches. During work performed on shutdown of the boiler, the doors may be opened completely, so that maintenance will be easier to perform.

Thus, the shielding room is typically defined by a ceiling, a front wall provided with at least one door, side walls and a wall of the boiler as the rear wall. Instead of an angular form, the shielding room can have other forms also. For instance, the side walls and the front wall can form a continuous curved wall provided with a door or doors.

The door or doors of the front wall of the shielding room are opened for the period of working in the shielding room. Normal daily maintenance operations in the smelt spout area, e.g. cleaning of the smelt spouts, regulation of the control devices for primary air or checking the performance of the flushing of the shielding cover (hood) of the smelt spouts, usually take some minutes. After these possible operations, the shielding room may be left and the door or doors closed. For safety reasons, the doors of the shielding room are not to be closed during working inside, since in case of smelt flush or other disturbance condition immediate exit from the shielding room is to be ensured.

Air conditioning may be arranged in the shielding room in order to keep the working temperature moderate and to remove the fumes and gases coming from the smelt spouts. Good lighting can further improve the safety of the shielding room during working.

By automating the objects of maintenance in the shielding room, visits to the shielding room may be minimized. For instance, automatic rodding devices can be arranged in the smelt spouts, as well as in air openings, typically primary air openings, in the shielding room area.

In this invention, the whole smelt spout area is protected as a separated space so that persons not working in the smelt spout area are safe. The shielding room does not provide an essential change to conventional working in the smelt spout area, but the internal working area inside the shielding room is free and unobstructed for allowing fluent working.

SUMMARY OF THE DRAWINGS

The present invention is described in more detail by means of embodiments according to the invention and with reference to the accompanying schematic drawings, in which.

DETAILED DESCRIPTION OF THE INVENTION

Figure 1:
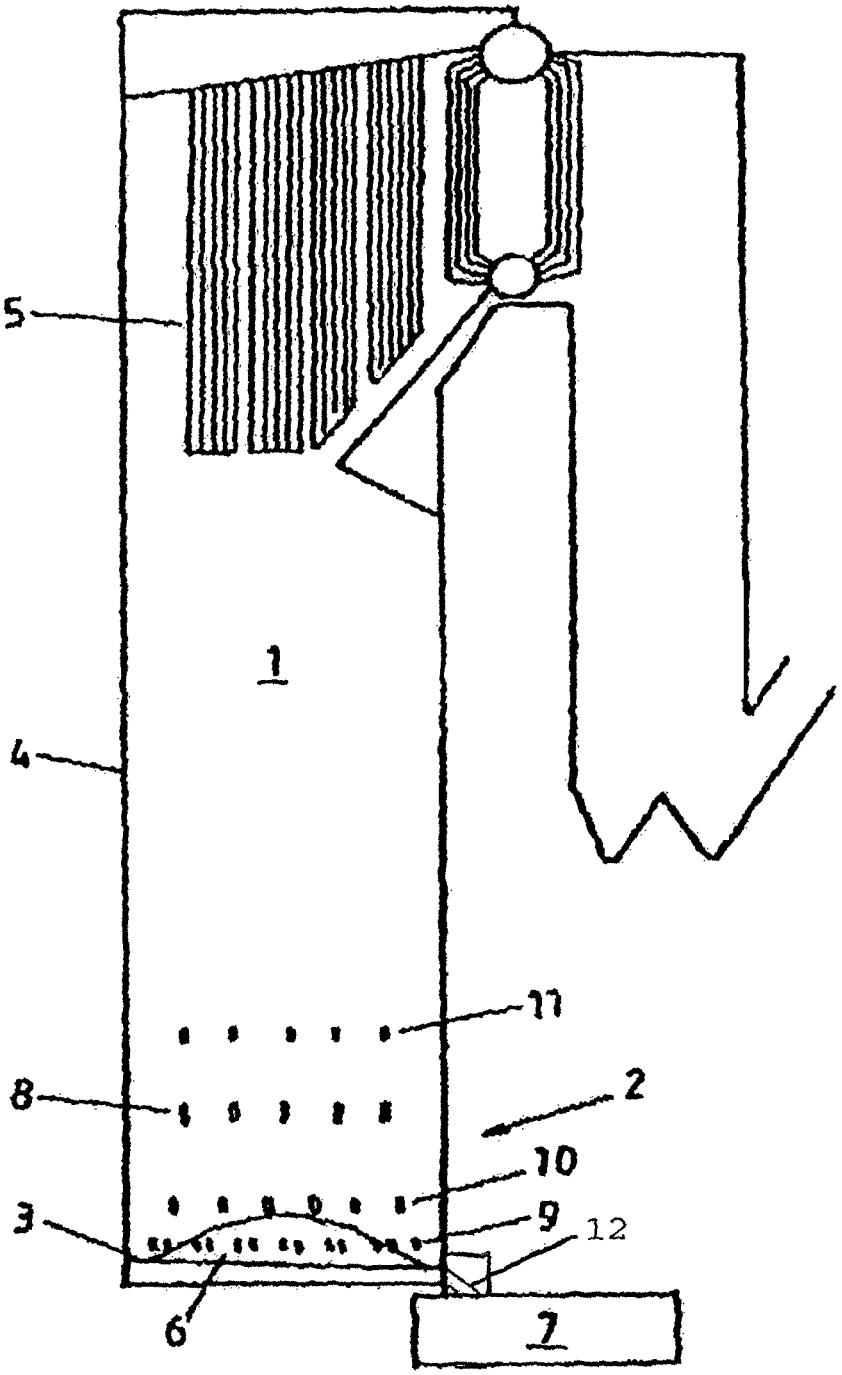
FIG. 1 illustrates a conventional recovery boiler.

FIG. 1 illustrates a conventional recovery boiler. The recovery boiler 1 comprises a furnace 2 having a bottom, walls 4 of the boiler and a super heater 5. The furnace of the boiler has a front wall, a rear wall and side walls. Black liquor spraying devices are located on these walls on one level or several levels. A number of air openings are arranged in said walls on several horizontal levels for feeding air into the furnace from an air source. Black liquor dried and partly burned in the combustion process forms a bed onto the bottom of the furnace. Melted chemicals flow through the porous bed onto the bottom of the furnace, from where they are transferred as overflow via smelt spouts 12 into a dissolving tank 7. Black liquor is introduced into the furnace via openings in zone 8. Air is introduced from three separate levels: from primary air openings 9, from secondary air openings 10 and from tertiary air openings 11. The number of air levels may be more than three.

Figure 2:
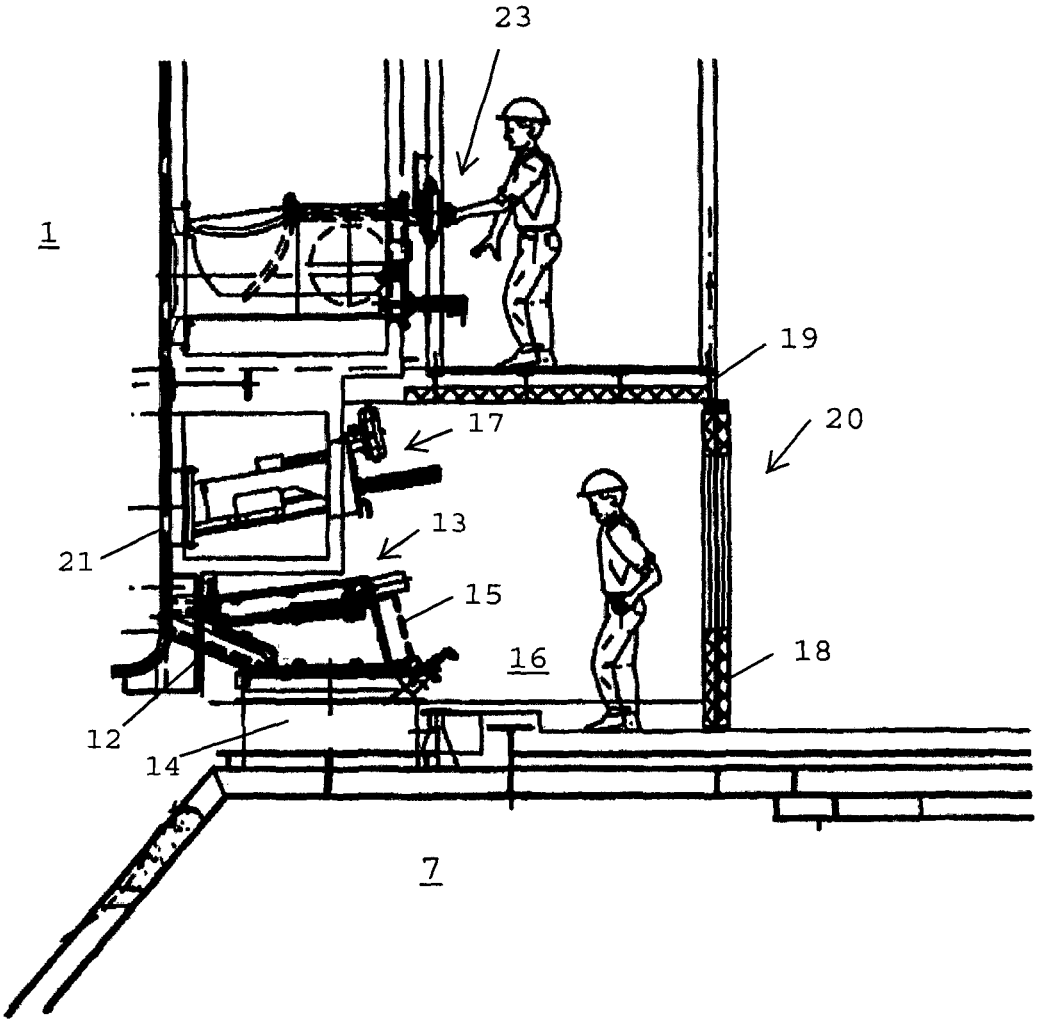
FIG. 2 illustrates an elevational section of a shielding room according to a solution of the invention in side view.

FIG. 2 illustrates the smelt spout area in more detail. The part of the smelt spout 12 that extends to the outside of the furnace wall of the boiler is surrounded usually by a closed hood 13, i.e. shielding housing, by means of which the passing of liquid and smelt splashes and vent vapors into the surroundings is decreased. The bottom part 14 of the hood is connected to a smelt dissolving tank 7 located below the smelt spout, into which tank the smelt falls from the spout 12 and wherein the smelt is dissolved in liquid forming green liquor. Smelt splashes can enter and stick to the hood and the walls of the dissolving tank. Smelt cakes thus formed cause explosions when falling into the dissolving tank, which is heard as noise. The upper part of the hood further includes a cover 15, through which the smelt spout can be rodded, if needed.

In front of the smelt spouts is a working space 16, where it is inevitable to work at times for controlling the smelt spouts and the equipment 17 of the primary air level located above the smelt spouts, and for performing maintenance and overhaul operations. The smelt spout area, which comprises the smelt spouts 12 with equipment, such as e.g. the hood 13, and said working space 16, is according to the invention isolated from the rest of the boiler plant space by means of a shielding wall 18 and a ceiling 19. Thus, a shielding room 20 or shielding space is formed, which separates the smelt spout area from the rest of the spaces. The shielding room is a space, the wall or walls 18, 22, and ceiling 19 of which are preferably made of sound insulating and heat-resistant material. A wall of the recovery boiler, typically the rear wall 21, acts as the rear wall of the shielding room, against which wall the ceiling 19 and the side walls 22 (FIG. 3) are sealed in a suitable way.

The primary air-nozzles with equipment 17 are located in the shielding room above the smelt spouts, the controlling and maintenance of which air-nozzles can be performed there. The secondary air nozzles 23 are located above the shielding room.

Figure 3:
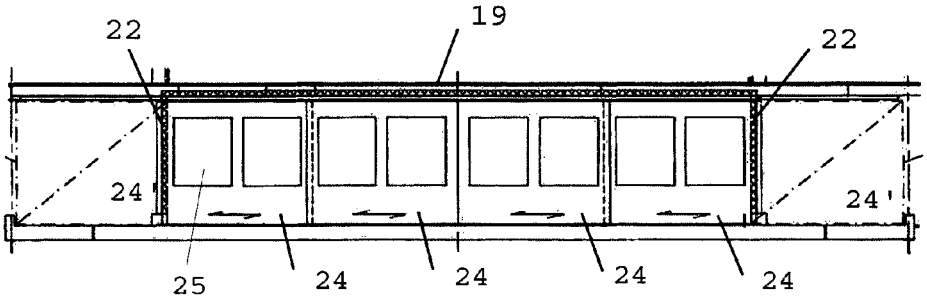
FIG. 3 illustrates the front wall with its door of the shielding room of the smelt spout area.
Figure 4:
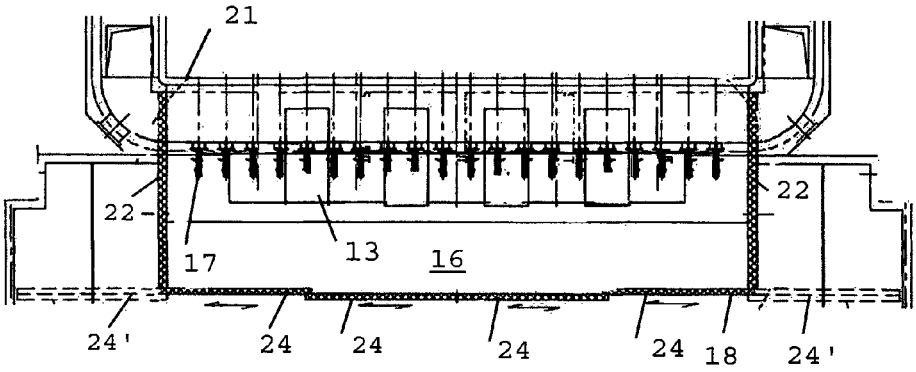
FIG. 4 illustrates the smelt spout area according to FIG. 3 isolated by a shielding wall, seen from above.

A wall of the shielding room, typically wall 18 opposite the smelt spouts, is provided with a door or doors 24. In this embodiment, the whole front wall 18 is formed of doors 24. The doors may be horizontally moving sliding doors, vertically moving upward acting doors, doors pivoted at the sides or on top or other lamella or folding doors. The door is to be such that a sufficient sound-insulation can be arranged therein. The doors of the shielding room may be manual, i.e. be opened and moved using muscular strength, or motorized, moving by machine force. An advantageous embodiment is a sliding door, as illustrated in FIGS. 3 and 4. The sliding door can be moved aside for access to the working area 16. In FIGS. 3 and 4 reference numeral 24' marks the position of the doors when they are open.

The doors or walls of the shielding room can be provided with a window or windows, which provide a safe view to the smelt spout area from outside the room. In FIG. 3 the doors 24 are provided with windows 25. Monitoring of the equipment located in the shielding room is thus possible to perform to some extent also from outside the room through windows, whereby working in the vicinity of the smelt spouts can be minimized and adverse effects caused can thus be reduced.

The door or doors can also be provided with opening hatches.

The doors 24 of the front wall 18 of the shielding room are opened (position 24') for the period of working in the shielding room 20. Normal daily maintenance operations in the smelt spout area, e.g. cleaning of the smelt spouts, regulation of the control devices for primary air or checking the performance of the flushing of the hood of the smelt spouts, usually take some minutes. After these possible operations, the shielding room may be left and the door or doors 24 closed.

Due the shielding room structure according to the present invention, working and walking in the recovery boiler plant is more efficient and safer than with known structures. The noise level and emissions in the surroundings of the lower part of the boiler can be significantly reduced. The number of shielding rooms may be one or more to surround the smelt spouts and the working space or spaces in front of them.

Although the above description relates to an embodiment of the invention that in the light of present knowledge is considered the most preferable, it is obvious to a person skilled in the art that the invention can be modified in many different ways within the broadest possible scope defined by the appended claims alone.

The invention claimed is:

1. A recovery boiler plant of a chemical pulp mill comprising:

a boiler including a wall having lower region with an outlet to discharge smelt;

a dissolving tank proximate to the outlet and configured to receive smelt from the outlet;

a smelt spout coupled to the outlet and including a chute extending from the outlet to a position at or over an inlet to the dissolving tank;

a shielding hood covering the chute and over at least a portion of a upper region of the dissolving tank, and a shielding room adjacent the wall of the boiler and above the dissolving tank, and the shielding room including walls, a ceiling and a floor, wherein one of the walls includes the lower region of the wall of the boiler, the floor is above the dissolving tank and the ceiling is at an elevation above the lower region of the wall, and the shielding hood is at least partially within the shielding room and separates the shielding room from the chute;

wherein the walls, the ceiling and the floor of the shielding room enclose a work volume adjacent the boiler and above the dissolving tank, wherein the work volume is configured as a working space for a person.

2. The recovery boiler plant according to claim 1, wherein the walls of the shielding room includes a door to the shielding room.

3. The recovery boiler plant according to claim 2 wherein the ceiling and walls of the shielding room are sealed to suppress noise and emissions from the smelt spout area to outside of the shielding room.

4. The recovery boiler plant according to claim 2 further comprising sound-insulating material within or covering the ceiling and at least one of the walls.

5. The recovery boiler plant according to claim 2 further comprising heat-insulating material within or covering the ceiling and at least one of the walls.

6. The recovery boiler plant according to claim 2 further comprising a sound-insulating material within or covering the door.

7. The recovery boiler plant according to claim 2 wherein the door is movable between an open position and a closed position.

8. The recovery boiler plant according to claim 1 wherein the lower region of the wall includes primary air nozzles and the primary air nozzles are adjacent the shielding room.

9. The recovery boiler plant of claim 1 wherein the shielding hood includes a cover configured to allow access to the smelt spout from the shielding room.

10. The recovery boiler plant of claim 1 wherein the shielding hood includes a bottom part connected to the dissolving tank.

11. The recovery boiler plant of claim 1 further comprising an upper region of the wall of the boiler, wherein the upper region includes a secondary air nozzle and the upper region is above the lower region, and wherein the ceiling of the shielding room is at an elevation between the upper region and the lower region of the wall of the boiler.

12. A method of forming a shielding room at a recovery boiler plant of a chemical pulp mill having a smelt spout area, the method comprising:

enclosing the smelt spout area in a shielding room including walls, a ceiling and a floor, wherein a lower region of a wall of the recovery boiler forms one of the walls of the shielding room, the floor is above a dissolving tank and the ceiling is above a smelt outlet in the lower region of the wall;

positioning a smelt spout within the shielding room wherein the smelt spout extends from the smelt outlet in the lower region of the wall of the recovery boiler and to or over the dissolving tank, covering the smelt spout with a shielding hood at least partially in the shielding room and separating the shielding room from the smelt spout, and forming a work space area within the shielding room of sufficient area to enable a worker to be in the shielding room.

13. The method of claim 12 wherein the formation of the work space includes installing a door in one of the walls.

14. The method of claim 12 wherein the formation of the work space includes insulating the ceiling and the walls, other than the lower region of the wall formed by the boiler, to suppress noise emanating from smelt flowing through the smelt spout and outside of the shielding room.

15. The method of claim 12 further comprising including a cover of the shielding hood, wherein the cover is configured to allow access to the smelt spout from the shielding room.

16. The method of claim 12 further comprising including a bottom part of the shielding hood, and the method includes connecting the bottom part to the dissolving tank.

17. The method of claim 12 further comprising an upper region of the wall of the boiler, wherein the upper region includes a secondary air nozzle and the upper region is above the lower region, and the method further comprises positioning the ceiling of the shielding room at an elevation between the upper region and the lower region of the wall of the boiler.

18. A method of forming a shielding room at a recovery boiler plant of a chemical pulp mill having a lower region with a smelt outlet, a smelt spout extending from the smelt outlet to a dissolving tank and a shielding hood covering at least a portion of the smelt spout, the method comprising:

forming a shielding room including walls, a ceiling and a floor, wherein the lower region of a wall of the recovery boiler forms one of the walls of the shielding room, the floor is above the dissolving tank and the ceiling is above the smelt outlet in the lower region;

arranging the shielding room such that the smelt spout is within the shielding room; and forming a work space area within the shielding room of sufficient area to enable a worker to be in the shielding room.

19. The method of claim 18 wherein the formation of the work space includes installing a door in one of the walls.

20. The method of claim 18 wherein the formation of the work space includes insulating the ceiling and the walls, other than the lower region of the wall formed by the boiler, to suppress noise emanating from smelt flowing through the smelt spout and outside of the shielding room.

21. The method of claim 18 wherein the recovery boiler plant is preexisting and the forming of the shielding room occurs after the recovery boiler plant is constructed.

22. The method of claim 18 further comprising including a cover of the shielding hood, wherein the cover is configured to allow access to the smelt spout from the shielding room.

23. The method of claim 18 further comprising including a bottom part of the shielding hood, and the method includes connecting the bottom part to the dissolving tank.

24. The method of claim 18 wherein the wall of the recovery boiler includes a secondary air nozzle above the lower region, and the method further comprises positioning the ceiling of the shielding room at an elevation between the upper region and secondary air nozzle.

25. A method to construct a shielding room at a recovery boiler having a lower region with a smelt outlet, a smelt spout extending from the smelt outlet to a tank and a shielding hood covering at least a portion of the smelt spout, the method comprising:

forming a shielding room including walls, a ceiling and a floor, wherein the walls include a wall of a lower region the recovery boiler, the floor is above the dissolving tank and the ceiling is above the smelt outlet;

arranging the shielding room such that the smelt spout is within the shielding room; and forming a work space area within the shielding room of sufficient volume to enable a worker to be in the shielding room during operation of the recovery boiler.

26. The method of claim 25 wherein the formation of the work space includes installing a door in one of the walls.

27. The method of claim 25 wherein the formation of the work space includes insulating the ceiling and the walls, other than the lower region of the wall formed by the boiler, to suppress noise emanating from smelt flowing through the smelt spout and outside of the shielding room.

28. The method of claim 25 wherein the recovery boiler plant is preexisting and the forming of the shielding room occurs after the recovery boiler plant is constructed.

29. The method of claim 28 further comprising including a cover of the shielding hood, wherein the cover is configured to allow access to the smelt spout from the shielding room.

30. The method of claim 25 further comprising including a bottom part of the shielding hood, and the method includes connecting the bottom part to the dissolving tank.

31. The method of claim 25 wherein the wall of the recovery boiler includes a secondary air nozzle above the lower region, and the method further comprises positioning the ceiling of the shielding room at an elevation between the upper region and secondary air nozzle.

* * * * *